US011602018B2

(12) United States Patent
Zhang et al.

(10) Patent No.: US 11,602,018 B2
(45) Date of Patent: Mar. 7, 2023

(54) HEATING ELEMENT AND HEATER HAVING SAME

(71) Applicant: Shenzhen First Union Technology Co., Ltd., Shenzhen (CN)

(72) Inventors: Shufeng Zhang, Shenzhen (CN); Zongping Yu, Shenzhen (CN); Zhongli Xu, Shenzhen (CN); Yonghai Li, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 786 days.

(21) Appl. No.: 16/572,550

(22) Filed: Sep. 16, 2019

(65) Prior Publication Data

US 2020/0085103 A1 Mar. 19, 2020

(30) Foreign Application Priority Data

Sep. 17, 2018 (CN) ..... 201811084216.5

(51) Int. Cl.
*H05B 3/42* (2006.01)
*H05B 3/06* (2006.01)

(52) U.S. Cl.
CPC ..... *H05B 3/42* (2013.01); *H05B 3/06* (2013.01)

(58) Field of Classification Search
CPC ..... H05B 3/42; H05B 3/06
USPC ..... 131/329
See application file for complete search history.

(56) References Cited

U.S. PATENT DOCUMENTS

| | | | | |
|---|---|---|---|---|
| 11,405,986 | B2 * | 8/2022 | Courbat | A24F 40/50 |
| 2021/0337868 | A1 * | 11/2021 | Mazur | A24F 40/20 |
| 2022/0071273 | A1 * | 3/2022 | Kontarev | A24F 40/20 |
| 2022/0125107 | A1 * | 4/2022 | Moloney | A24F 40/40 |
| 2022/0126038 | A1 * | 4/2022 | Monsalud | A61M 15/0041 |
| 2022/0175022 | A1 * | 6/2022 | Papakyrillou | A24D 1/20 |
| 2022/0192253 | A1 * | 6/2022 | Papakyrillou | A24D 1/20 |
| 2022/0192261 | A1 * | 6/2022 | McGrath | A24F 40/20 |
| 2022/0202089 | A1 * | 6/2022 | Illidge | A24F 40/40 |
| 2022/0202092 | A1 * | 6/2022 | Illidge | A24F 40/485 |
| 2022/0218023 | A1 * | 7/2022 | Fuisz | A24F 40/60 |
| 2022/0232900 | A1 * | 7/2022 | Bilat | A24F 40/60 |

FOREIGN PATENT DOCUMENTS

| | | |
|---|---|---|
| CN | 204120238 U | 1/2015 |
| CN | 204949519 U | 1/2016 |
| CN | 207023242 U | 2/2018 |

* cited by examiner

*Primary Examiner* — Alexander Gilman
(74) *Attorney, Agent, or Firm* — PROI Intellectual Property US; Klaus Michael Schmid

(57) ABSTRACT

A heating element for heating cigarette and a heater are disclosed, the heating element includes: a heating part at a proximal end of the heating element, with a longitudinal axis along the longitudinal direction of the heating element; the heating part is configured for inserting inside the cigarette along the longitudinal direction; a fixing part at a distal end of the heating element and secured with the heating part, the fixing part is provided with an air inlet; the heating part comprises an air flow path formed therein and extending along the longitudinal direction; the air inlet is in communication with the air flow path; the heating part is bored with an air hole that communicates the air flow path with outside the heating part, such that the air flow in the air flow path is flowing into the cigarette.

15 Claims, 11 Drawing Sheets

HEATING ELEMENT AND HEATER HAVING SAME

TECHNICAL FIELD

The present disclosure relates to the field of smoking articles, and in particular to a heating element and a heater having same.

BACKGROUND ART

The traditional cigarette as an addictive product is attracted by many people, however, tar and the carbon monoxide in the cigarette may endanger people's health, and particularly tar containing tens of carcinogen, which may greatly affect people's health. Currently, governments have stipulated that smoking in public is prohibited. However, for addicted smokers, they can't completely give up smoking, thus, many substitutes are appeared imitating traditional cigarettes, such as smoking cessation buccal tablets and electronic cigarettes etc.

In recent years, the electronic cigarettes include a kind of non-burning baking smoking articles, by the non-burning baking the cigarette to generate smoking smog, which would effectively reduce noxious substance. The non-burning smoking articles in the market typically include a heater, in which, a heating method of the heater is divided into annular heating and core heating, by relying on the heater with core heating, the cigarette is inserted into the heater for heated to generate an aerosol.

During the invention process, the inventors found that the prior art heater with central heating, the non-burning baking smoking article has heat concentrated on a core area of the article leading to burnt flavor around the core area of the cigarette, but peripheral area of the cigarette failed to contact the heating element is generally baked incompletely which causes the cigarette to be heated unevenly and affects the smoke yield and user's taste.

SUMMARY

To overcome the above drawbacks that the cigarette can't be heated evenly, the present disclosure generally relates to a heating element and a heater having the same.

In a first aspect, the present disclosure provides a heating element according to independent claim 1 whereas various embodiments of the heating element and improvements thereto are recited therein. The heating element includes: a heating part at a proximal end of the heating element, with a longitudinal axis along the longitudinal direction of the heating element; the heating part is configured for inserting inside the cigarette along the longitudinal direction;

a fixing part at a distal end of the heating element and secured with the heating part, the fixing part is provided with an air inlet;

the heating part includes an air flow path formed therein and extending along the longitudinal direction; the air inlet is in communication with the air flow path;

the heating part is bored with an air hole that communicates the air flow path with outside the heating part, such that the air flow in the air flow path is flowing into the cigarette.

As used herein, the air holes includes numerous air holes evenly spaced and disposed on the heating part along a longitudinal direction of the heating part.

As used herein, the air holes include numerous first air holes constituting a first air hole set, and numerous second air holes constituting a second air hole set; a line of connecting numerous first air holes, a line of connecting numerous second air holes and the longitudinal axis are parallel among each other; the first air holes and the second air holes are staggered to set along the longitudinal axis.

As used herein, the heating part includes a first transverse axis perpendicular and intersected with the longitudinal axis; the first transverse axis and the longitudinal axis are identified as a first surface; the first air holes are numerous and symmetrically set with the first surface.

As used herein, the heating part further includes a second longitudinal axis that is perpendicular and intersected with the first transverse axis and the longitudinal axis; a width of the heating part is progressively decreasing from near and far from the fixing part.

As used herein, the heating part further includes a second transverse axis that is perpendicular and intersected with the first transverse axis and the longitudinal axis; the second transverse axis and the longitudinal axis are identified as the second surface; the heating part comprises a first side wall, a second side wall, a third side wall and a fourth side wall surrounded the air flow path; the first side wall and the fourth side wall are disposed at an identical side of the second surface; the second side wall and the third side wall are disposed at the other opposite side of the second surface; the first side wall, the second side wall, the third side wall and the fourth side wall are provided with the numerous air holes.

As used herein, a distance between the first side wall and the fourth side wall is progressively decreasing from near and far from the second surface; a distance between the second side wall and the third side wall is progressively decreasing from near and far from the second surface.

As used herein, the heating element further includes a fifth side wall, a sixth side, a seventh side wall and an eighth side wall; the fifth side wall is configured for connecting the first side wall and the fourth side wall; the sixth side wall is configured for connecting the first side wall and the second side wall; the seventh side wall is configured for connecting the second side wall and the third side wall; the eighth side wall is configured for connecting the third side wall and the fourth side wall; the heating part further includes a first end wall, a second end wall and a third end wall; the first end wall, the second end wall and the third end wall are disposed at the proximal end of the first side wall, the fixing part is disposed at a distal end of the first side wall; the first end wall and the second surface are perpendicular and intersected; the first end wall is configured for connecting the sixth side wall and the eighth side wall, the second end wall is configured for connecting the first side wall, the fourth side wall and the fifth side wall; a height of the second end wall is progressively decreasing from near and far from the second surface; the third end wall is configured for connecting the second side wall, the third side wall and the seventh side wall; a height of the third end wall is progressively decreasing from near and far from the second surface.

As used herein, the heating part includes a body and two wings, the two wings are disposed at two opposite sides of the body.

As used herein, the body includes at least one first air hole set extending through the two opposite sides of the body; numerous first air holes in each first air hole set are evenly spaced and disposed on the body.

As used herein, the first air hole sets includes two first air hole sets, lines for connecting centers of numerous first air holes in each first air hole set are parallel with each other; the wings are disposed at middle of the two first air hole sets.

As used herein, each wing includes a second air hole set extending through two opposite sides of the wing; numerous second air holes in each second air hole set are evenly spaced and disposed on the wing.

As used herein, the first air holes and the second air holes are staggered to set along the longitudinal axis of the heating part.

As used herein, the heating part includes a tube-shaped structure with an end opened.

In a second aspect, the embodiments provides a heater including:

a heating element; and a supporter; the supporter includes a receptacle for receiving the cigarette, the heater is disposed in the receptacle; the heater is configured for inserting into the cigarette; the heating element according to any one of aforementioned heating element.

As used herein, the heater further includes a coil, a first limiting part and a second limiting part are spaced and disposed on a periphery of the supporter, the coil is disposed between the first limiting part and the second limiting part.

Compared to the prior art, the heating element includes an air flow path therein, and the heating element is bored with air holes in communication with the air flow path. Along with the user's drawing action, the external air is flowing through the air flow path and the air holes towards the heating element, carrying the aerosol in a certain temperature to diffuse around the cigarette, thus to preheat the cigarette, thus the cigarette is heated evenly. When the external air in a comparatively low temperature is flowing into the air flow path of the heating element, the air would take some heat around a core of the heating element to reduce the temperature thereof, therefore avoiding the cigarette is over-burnt at the core area, ensuring the user's taste and aiding the tobacco cigarette to generate maximum aerosol.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

Figure 1:
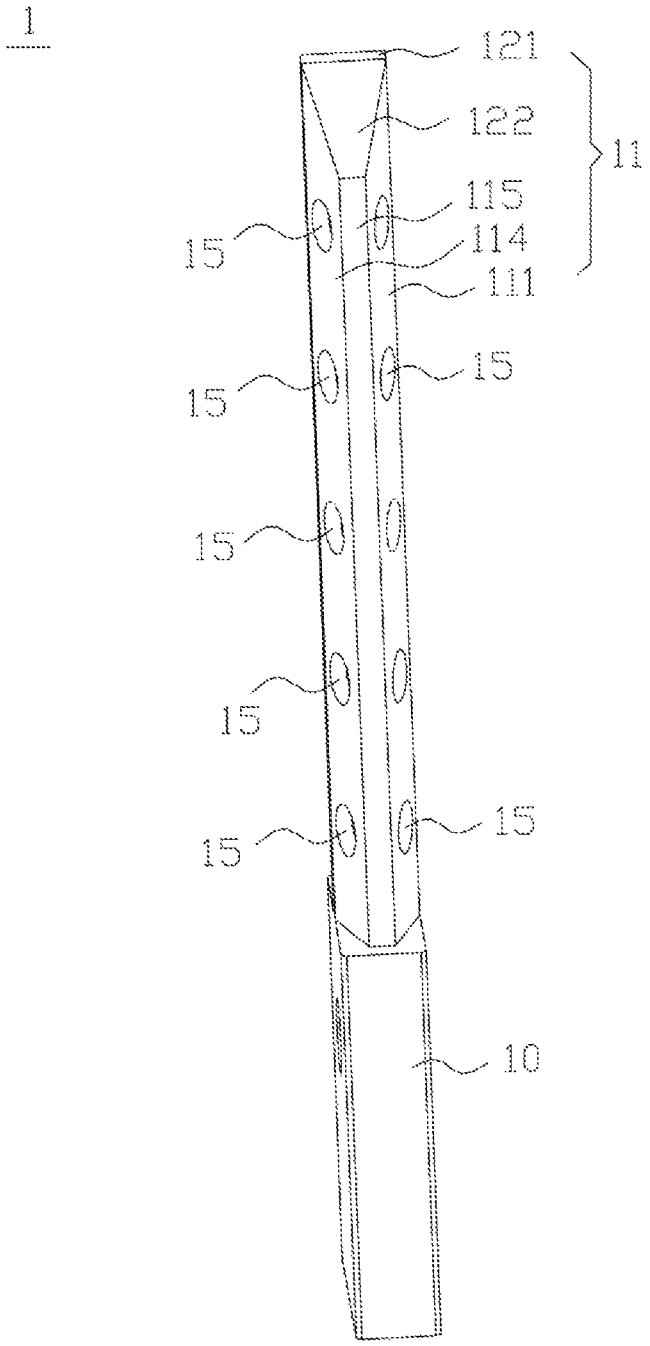
FIG. 1 is an isometric view of a heating element according to a first embodiment of the present disclosure.
Figure 2:
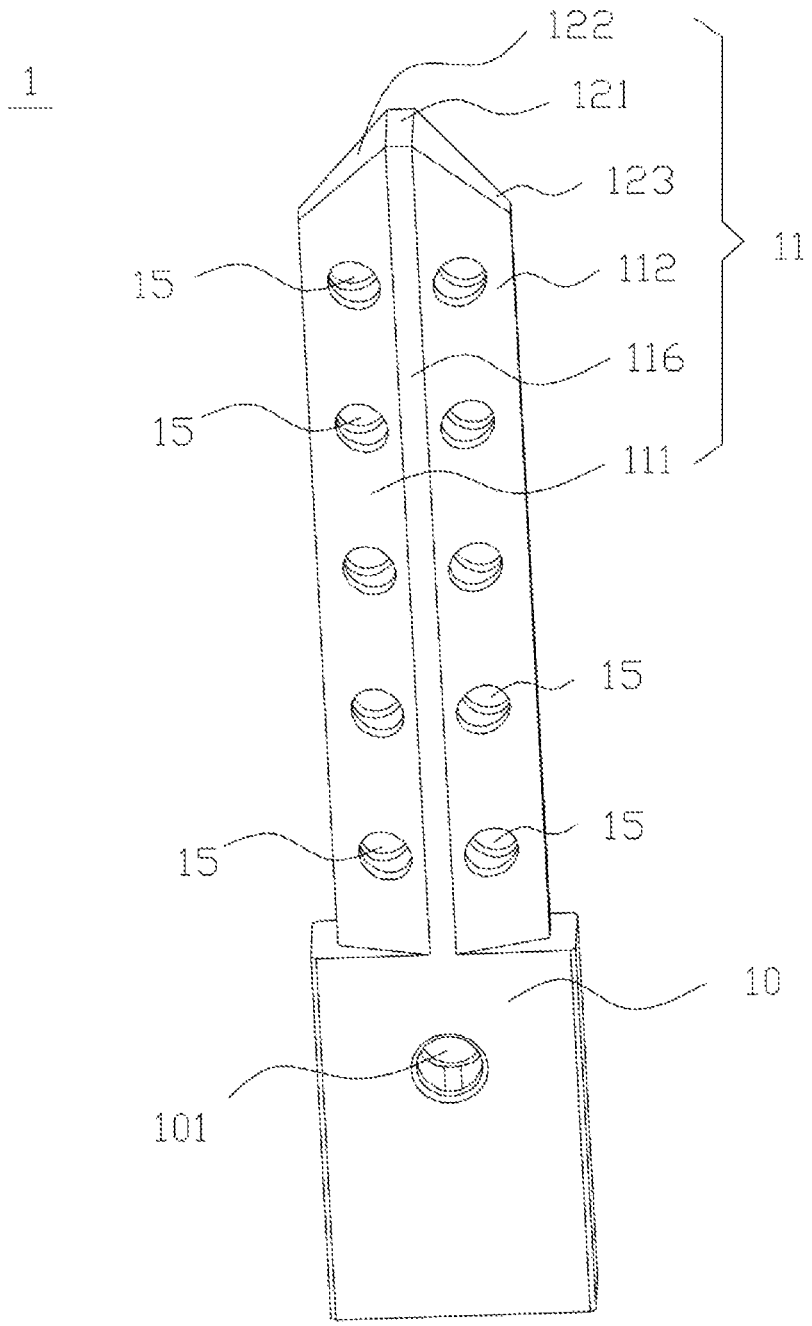
FIG. 2 is an isometric view of the heating element in FIG. 1 from another perspective.
Figure 3:
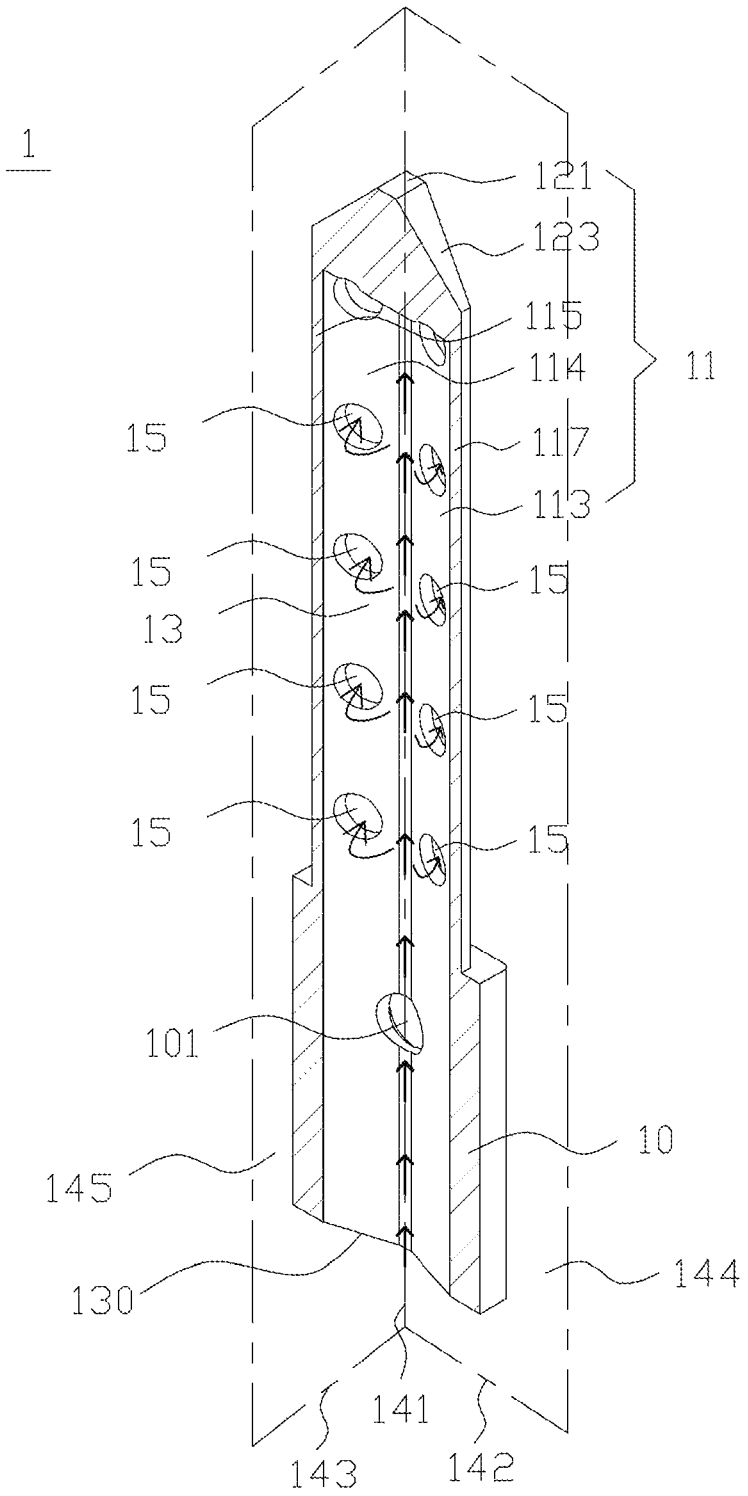
FIG. 3 is a cross-sectional view of the heating element according to the first embodiment of the present disclosure.
Figure 4:
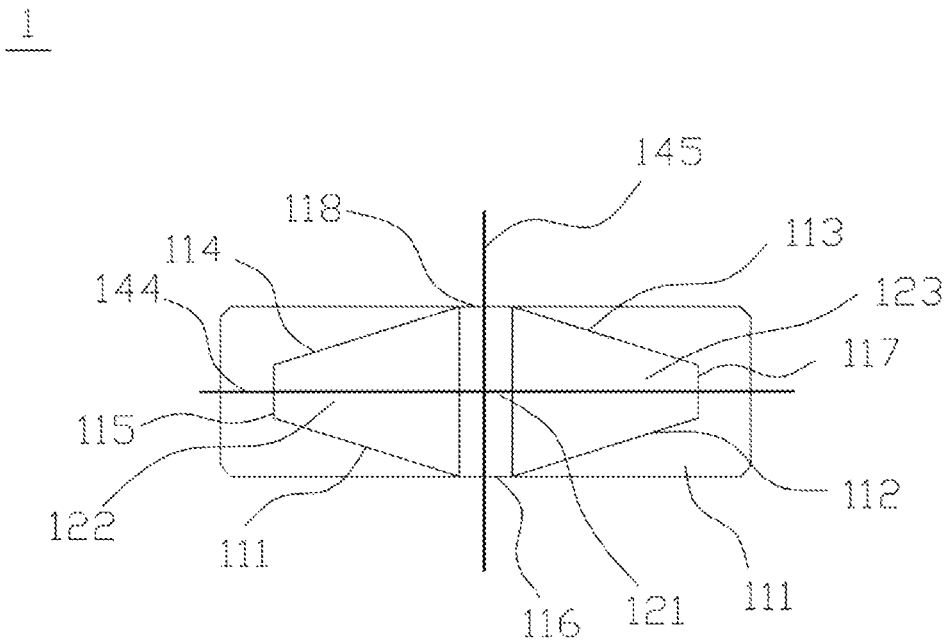
FIG. 4 is a top view of the heating element according to another embodiment of the present disclosure.

| | | | |
|---|---|---|---|
| Heating element 1, 2 | Fixing parts 10, 20 | Fixing holes 101, 201 | Heating parts 11, 21 |
| First side wall 111 | Second side wall 112 | Third side wall 113 | Fourth side wall 114 |
| Fifth side wall 115 | Sixth side wall 116 | Seventh side wall 117 | Eighth side wall 118 |
| Air flow paths 13, 23 | First end wall 121 | Second end wall 122 | Third end wall 123 |
| Air inlets 130, 230 | Longitudinal axis 141 | First transverse axis 142 | Second transverse axis 143 |
| First surface 144 | Second surface 145 | Air hole 15 | Body 22 |
| First air hole 221 | First air hole set 24 | Wing 25 | Second air hole 251 |
| Second air hole set 26 | Heater 100 | Receptacle 3 | Supporter 4 |
| First limiting part 41 | Second limiting part 42 | Coils 5 | Base 6 |
| First base 61 | Fixing pole 611 | Second base 62 | Fixing hole 621 |
| Receiving slot 63 | Temperature sensor 7 | Electronic cigarette 200 | |

DETAILED DESCRIPTION

Provided herein are an electronically-operated aerosol-generating article (alternatively referred to as vaporization devices or electronic vaping devices etc.) generally heats a liquid aerosolizable material (i.e. tobacco liquid) containing nicotine to generate an aerosol, eventually drawn by the users.

Embodiment One

Referring to FIG. 1 to FIG. 4, a heating element 1 is provided in accordance with a first embodiment of the present disclosure. The heating element 1 includes a fixing part 10 at a distal end of the heating element 1 and a heating part 11 at a proximal end of the heating element. The fixing part 10 is plate-shaped, bored with a fixing hole 101 extending through two opposite sides thereof.

The heating part 11 is an elongate structure, having a longitudinal axis 141, a first transverse axis 142 and a second transverse axis 143. The longitudinal axis 141, the first transverse axis 142 and the second transverse axis 143 are perpendicular and intersected between any two of them. The longitudinal axis 141 and the first transverse axis 142 are identified as a first surface 144, that is, the longitudinal axis 141 and the first transverse axis 142 are positioned on the first surface 144. The longitudinal axis 141 and the second transverse axis 143 are identified as a second surface 145, that is the second longitudinal axis 141 and the second transverse axis 143 are positioned on the second surface 145. The second surface 145 and the first surface 144 are perpendicular and intersected with each other. The first transverse axis 142 is along a transverse direction of the heating element 1, the second transverse axis 143 is along a direction of front and rear of the heating element 1, and the second longitudinal axis 141 is along a longitudinal direction of the heating element 1.

The heating part 11 includes a first side wall 111, a second side wall 112, a third side wall 113, a fourth side wall 114, a fifth side wall 115, a sixth side wall 116, a seventh side wall 117, a eighth side wall 118, a first end wall 121, a second end wall 122, a third end wall 123. The first side wall 111, the second side wall 112, the third side wall 113, the fourth side wall 114, the fifth side wall 115, the sixth side wall 116, the seventh side wall 117 and the eighth side wall 118 are extending towards the proximal end of the heating element 1 from the fixing part 10. That means the first side wall 111, the second side wall 112, the third side wall 113, the fourth side wall 114, the fifth side wall 115, the sixth side wall 116, the seventh side wall 117 and the eighth side wall 118 are extending along a direction of the longitudinal axis 141. The first end wall 121, the second end wall 122 and the third end wall 123 are disposed at a proximal end of the first side wall 111. The fixing part 10 is disposed at a distal end of the first side wall 111.

The heating part 11 is provided with an air flow path 13, an air inlet 130 of the air flow path 13 is disposed on the fixing part 10. In the embodiment, the air inlet 130 is disposed at a distal end of the fixing part 10, understandable, in other embodiments, the air inlets 130 are also disposed on a side wall of the fixing part 10. The first side wall 111, the second side wall 112, the third side wall 113, the fourth side wall 114, the fifth side wall 115, the sixth side wall 116, the seventh side wall 117 and the eighth side wall 118 are disposed around the air flow path 13. The first end wall 121, the second end wall 122 and the third end wall 123 are configured for sealing the air flow path 13, thus the heating element 1 forms a structure with the distal end opened and the proximal end closed.

The first side wall 111, the fourth side wall 114 and the fifth side wall 115 are disposed on an identical side of the second surface 145. The second side wall 112, the third side wall 113 and the seventh side wall 117 are disposed at an opposite side of the second surface 145. The first side wall 111 and the second side wall 112 are symmetrical with the second surface 145. The third side wall 113 and the fourth side wall 114 are symmetrical with the second surface 145. The fifth side wall 115 and the seventh side wall 117 are symmetrical with the second surface 145. The second end wall 122 and the third end wall 123 are symmetrical with the second surface 145. The first side wall 111 and the fourth side wall 114 are symmetrical with the first surface 144, the second side wall 112 and the third side wall 113 are symmetrical with the first surface 144; the sixth side wall 116 and the eighth side wall 118 are symmetrical with the first surface 144.

The fifth side wall 115 is configured for connecting the first side wall 111 and the fourth side wall 114; the fifth side wall 115 is parallel with the second surface 145. The sixth side wall 116 is parallel with the eighth side wall 118. The second surface 145 is extending through the sixth side wall 116 and the eighth side wall 118. The second surface 145 is perpendicular with the sixth side wall 116 and the eighth side wall 118. The sixth side wall 116 is configured for connecting the first side wall 111 and the second side wall 112, the eighth side wall 118 is configured for connecting the third side wall 113 and the fourth side wall 114. The second side wall 112, the third side wall 113 and the seventh side wall 117 are disposed on the opposite side of the second surface 145. The fifth side wall 115, the sixth side wall 116, the seventh side wall 117 and the eighth side wall 118 have an identical width separately.

A distance between the first side wall 111 and the fourth side wall 114 is gradually decreasing from near and far from the second surface 145. A distance between the second side wall 112 and the third side wall 113 is gradually decreasing from near and far from the second surface 145. Therefore a width of the heating part 11 in the second transverse axis 143 is from middle to gradually narrow towards two sides, causing the heating part 11 to be thick in the middle and thin the both sides and the heating part 11 is easy to insert into the cigarette.

The first side wall 111, the second side wall 112, the third side wall 113 and the fourth side wall 114 are bored with numerous air vents 15 that are symmetrically set with the first surface 144. That means, the air vent 15 bored on the first side wall 111 is symmetrical with the air vent 15 bored on the fourth side wall 114 relative to the first surface 144; the air vent 15 bored on the second side wall 112 is symmetrical with the air vent 15 bored on the third side wall 113 relative to the first surface 144. Along the longitudinal axis 141 of the heating part 11, numerous air vents 15 are evenly spaced and disposed on the first side wall 111, the second side wall 112, the third side wall 113 and the fourth side wall 114, that means, the numerous air vents 15 are evenly spaced and disposed on the heating part 11 along the longitudinal axis 141 thereof.

The air vents 15 are in communication with the air flow path 13, external air flows into the heating part 11 via an opening of the fixing part 10, departing from the heating part 11 through numerous air vents 15 and carrying some sort of heat from the heating part 11 to make the heat diffusing towards outside of the tobacco cigarette. On one hand, the external air would take away sort of the heat in the heating part 11 to aid in reduction of temperature of the heating part 11, which avoids overheating to burn the core area of the cigarette to ensure the user's taste. On the other hand, the air carrying some heat to diffuse towards outside of the tobacco cigarette generates a preheating effect for the outside of the tobacco cigarette, thus making the cigarette evenly heated and improving smoking yield of the cigarette.

The first end wall 121, the first surface 144 and the second surface 145 are perpendicular and intersected between any two of them. The first end wall 121 is configured for connecting the sixth side wall 116 and the eighth side wall 118. The second side wall 112 is configured for sealing the first side wall 111, the fourth side wall 114 and the fifth side wall 115. A height of the second side wall 112 is gradually decreasing from near and far from the second surface 145. The third side wall 113 is configured for connecting the second side wall 112, the third side wall 113 and the seventh side wall 117. A height of the second side wall 112 is gradually decreasing from near and far from the second surface 145. That is, the first side wall 111 is horizontally set, the width of the first side wall 111 is equal with that of the fifth side wall 115, making the proximal end of the heating part 11 as a structure high in the middle and low in two sides, and making the middle of the heating part 11 protruded for easily inserting into the cigarette.

In the embodiment, an air flow path 13 is provided inside the heating element 1 and the heating part 11 is provided with air vents 15 that are in communication with the air flow path 13. Along with the user's suction action, external air would flow into the air flow path 13 via the air inlet 130, then flowing out of the air vents 15 towards the heating element 1, and carrying the aerosol with a certain temperature towards the heating element 1, thus generating a preheating effect on the cigarette to make the cigarette heated evenly. And when external air in a relatively low temperature is flowing into the air flow path 13 of the heating part 11, the external air take away some sort amount of heat from the middle of the heating part 11, thus the middle of the heating part 11 is reduced, avoiding the middle area of the heating part 11 to generate burnt flavor, ensuring the user's suction taste and in favor of maximum production of aerosol from the cigarette.

In the embodiment, the heating part 11 includes an octagonal structure, understandable, in some other embodiments, the heating part 11 may also be a prism, a pyramid, a pentagonal prism, a hexagonal prism, a seven prism, a nine prism or a cylinder shaped structure, only need the heating part 11 bored with the air flow path 13.

Figure 5:
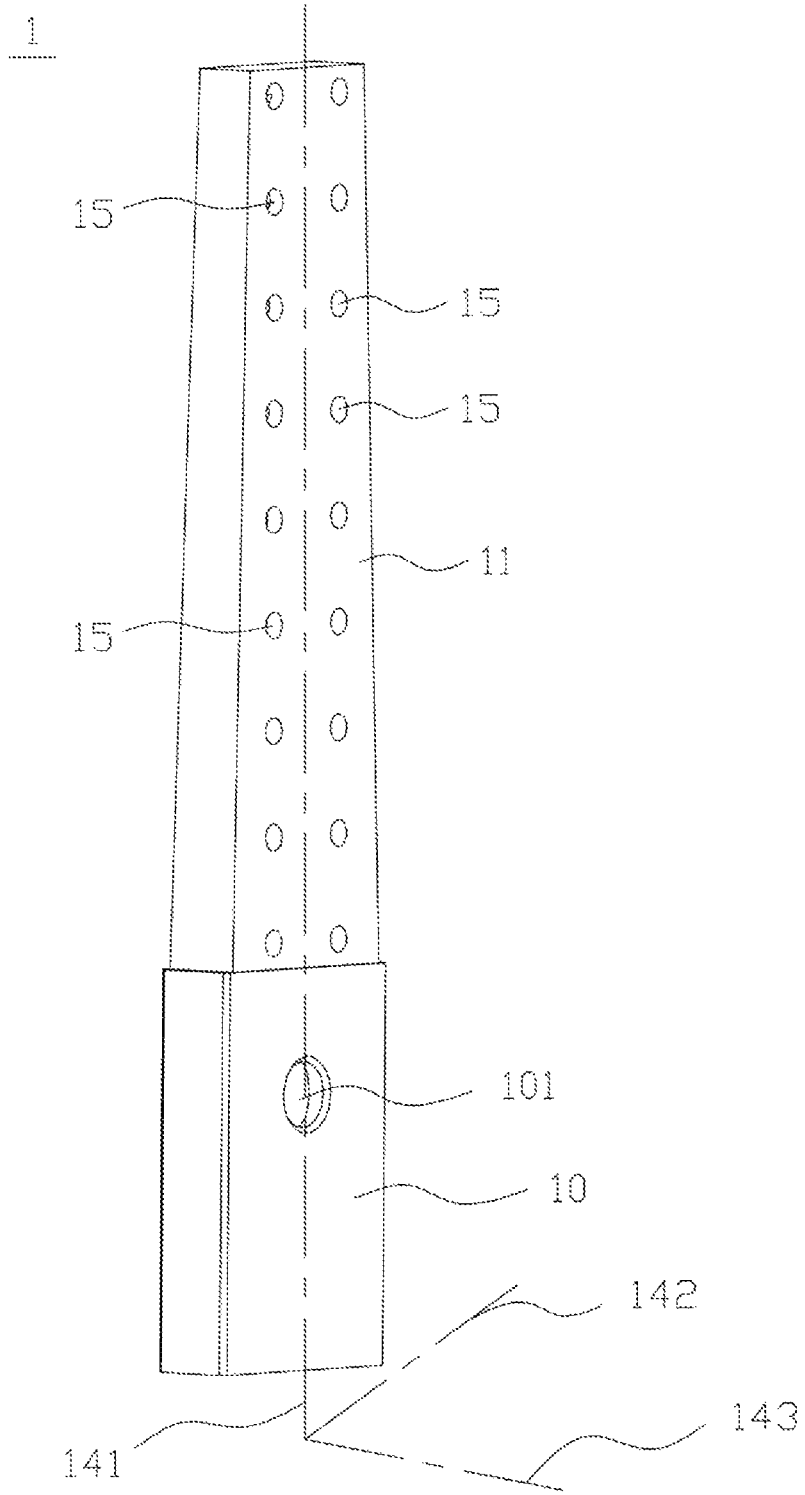
FIG. 5 is an isometric view of the heating element according to another embodiment of the present disclosure.

Referring to FIG. 5, which is an substitute scheme of the heating element 1 disclosed by the present disclosure. The heating part 11 of the heating element 1 has the first transverse axis 142 perpendicular and intersected with the longitudinal axis 141. Along the direction of the first transverse axis 142, the width of the heating part 11 is progressively decreasing from near and far from the fixing part 10. The heating part 11 of the heating element 1 has a second transverse axis 143 perpendicular and intersected with the longitudinal axis 143, along the direction of the second transverse axis 143, a width of the heating part 11 is progressively decreasing from near and far from the fixing part 10.

Embodiment Two

Figure 6:
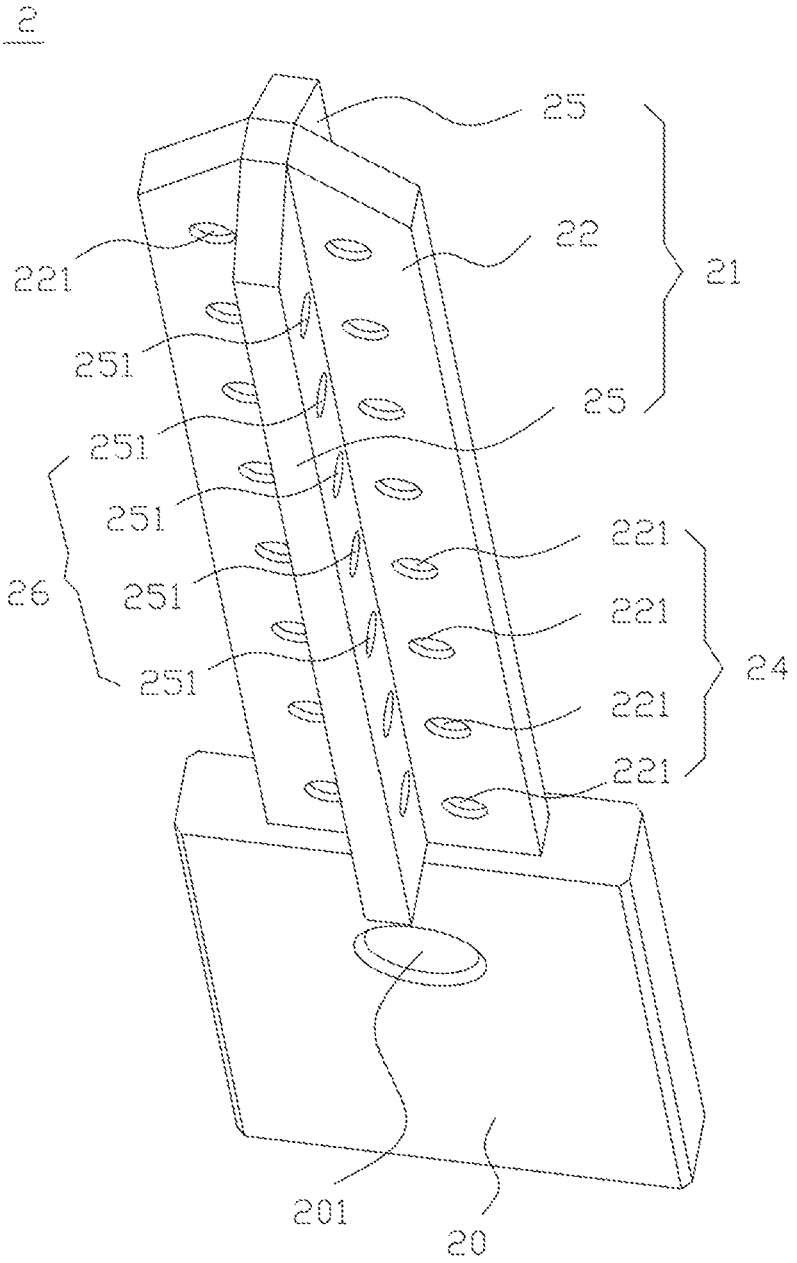
FIG. 6 is an isometric view of the heating element according to a second embodiment of the present disclosure.

Referring to FIG. 6, which shows a heating element 2 disclosed in accordance with the second embodiment of the present disclosure. The heating element 2 includes a fixing part 20 at a distal end of the heating element 2 and a heating part 21 at a proximal end of the heating element 2. The fixing part 20 is a plate-shaped structure, the fixing part 20 is bored with a fixing hole 210 extending through two opposite sides of the fixing part 20.

The heating part 21 includes a body 22 and two wings 25. The body 22 is extending towards the proximal end of the heating element 2. The body 22 is a plate-shaped, and two wings 25 are respectively disposed at two opposite sides of the body 22. The heating part 21 and the fixing part 20 are provided with an air flow path 23 capable of communicating an inner chamber of the body 22 and an inner chamber of the wings 25.

The body 22 is bored with numerous first air holes 221 extending through two opposite sides of the body 22. The numerous first air holes 221 are arrayed along a length direction of the heating part 21 to form two first air hole sets 24, in which, the first air holes 221 in each first air hole set 24 are evenly spaced on the body 22, and lines of connecting the numerous first air holes 221 are parallel among each other, the wings 25 are disposed between two first air hole sets 24.

Each wing 25 is provided with numerous second air holes 251 extending through two opposite sides of the wing 25. The numerous second air holes 251 are arrayed along a length direction of the heating part 21 to form two second air hole sets 26, the second air holes 251 in each second air hole set 26 are evenly spaced on the wing 25, and lines of connecting the numerous second air holes 251 are parallel among each other. Along a longitudinal direction of the heating part 21, the first air holes 221 and the second air holes 251 are staggered to set, that is, the first air holes 221 and the second air holes 251 have different distances from the distal end of the heating element 2, making external air respectively depart the heating part 21 via the first air holes 221 and the second air holes 251, therefore, the external air would take away the heat of different parts of the heating part 21 leading to even temperature on different parts of the heating part 21, as a result, the cigarette is heated evenly by the different parts of the heating part 21, which brings the user consistent smoking taste.

Embodiment Three

Figure 7:
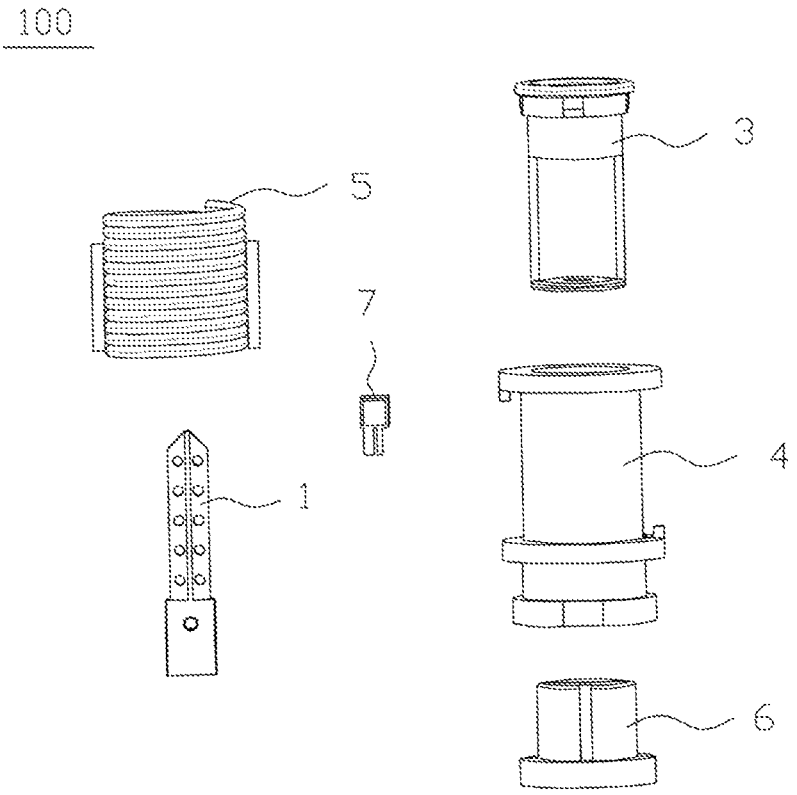
FIG. 7 is an isometric view of the heater according to a third embodiment of the present disclosure.
Figure 8:
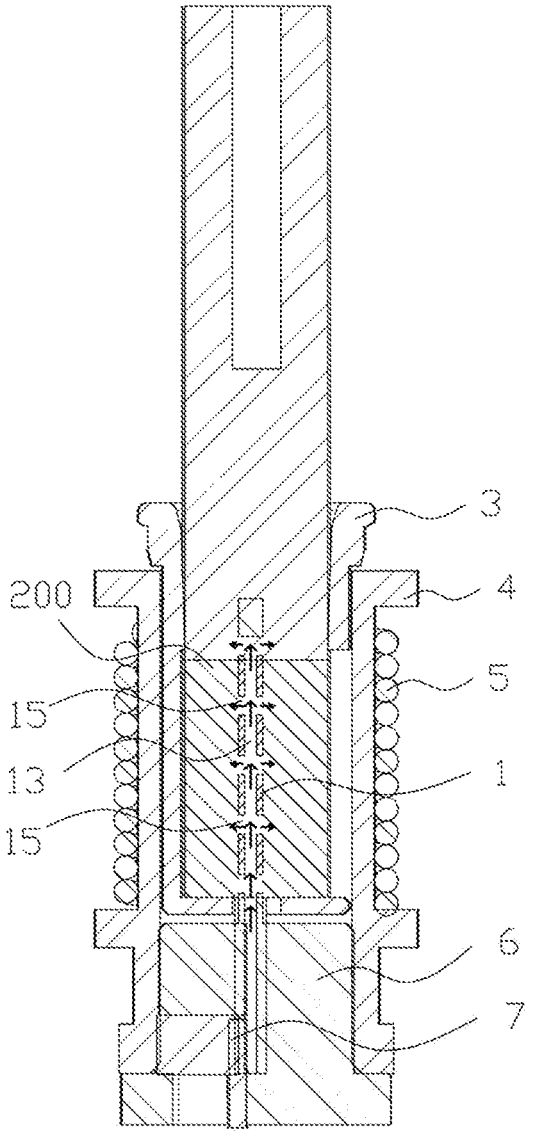
FIG. 8 is a cross-sectional view of the heater holding the cigarette according to the third embodiment of the present disclosure.

Referring to FIGS. 7 and 8, which provide a heater 100 according to a third embodiment of the present disclosure. The heater 100 includes a receptacle 3, a heating element 1(2), a supporter 4, a coil 5, a base 6 and a temperature sensor 7. As used herein, the heating element 1 is identical with the first embodiment and no further description thereto. The heating element 1 includes metallic materials with high magnetic permeability, at least one selected from a group of powdered iron core, iron-nickel 50, iron-silicon-aluminum and iron-nickel-molybdenum etc.

Understandable, the heating element 1 in the heater 100 may be the heating element 2 according to the second embodiment, this embodiment only describes the heating element 1 according to the first embodiment.

Figure 9:
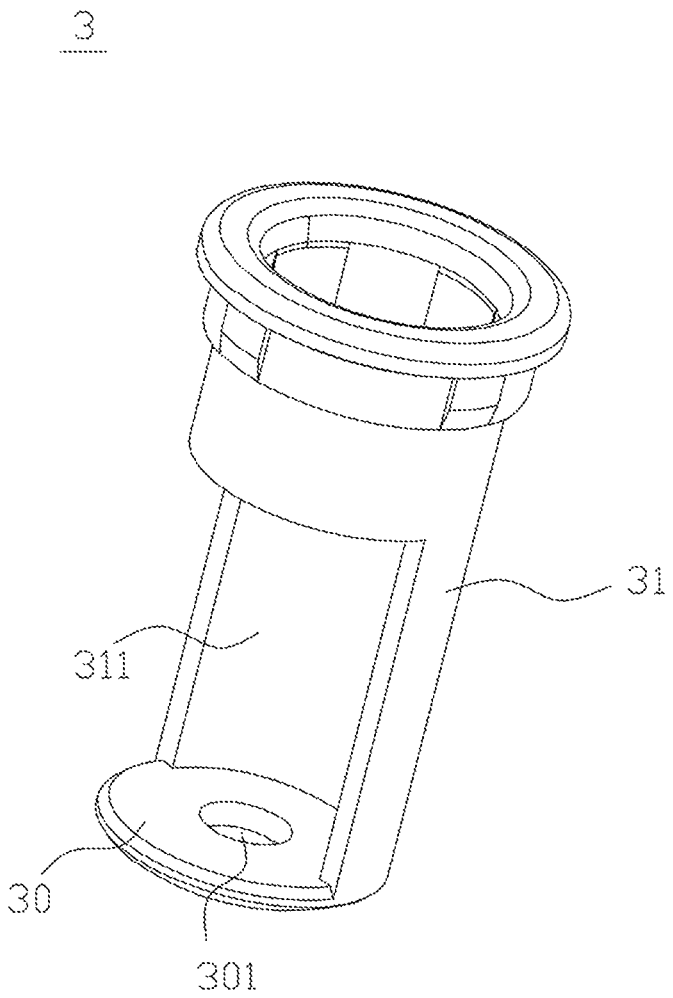
FIG. 9 is an isometric view of a receptacle in the heater according to the third embodiment of the present disclosure.

Referring to FIG. 7 to FIG. 9, the receptacle 3 includes a base wall 30 and a tube wall 31, the tube wall 31 is extending from the base wall 30 towards the proximal end of the heating element 1. The receptacle 3 is configured for receiving the cigarette 200. The tube wall 31 is provided with an opening 311. The base wall 30 is cored with a through hole 301 that is through the base wall 30. The through hole 301 has the heating part of the heating element passed through, further the heating part inserts into the cigarette 200.

The supporter 4 is a hollow sleeve, a first limiting part 41 and a second limiting part 42 are spaced and carried on a periphery of the supporter 4, the supporter 4 is sleeved on the receptacle 3.

Figure 10:
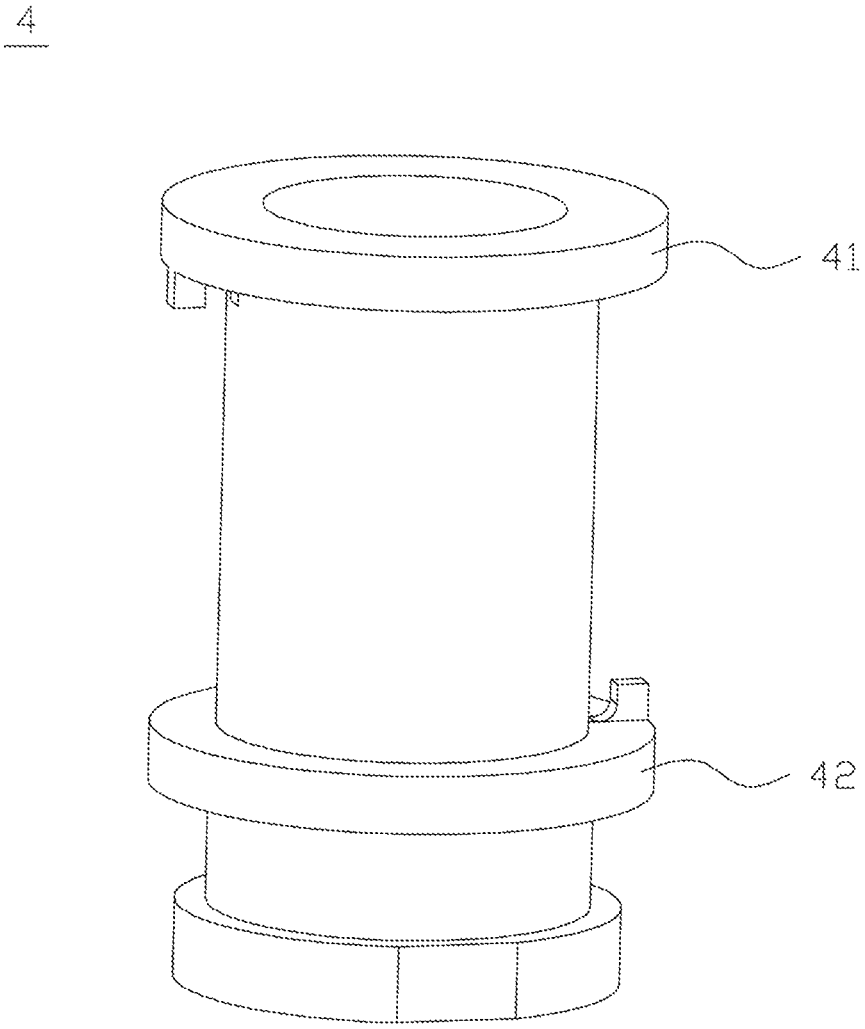
FIG. 10 is an isometric view of a supporter in the heater according to the third embodiment of the present disclosure.

Referring to FIGS. 7, 8 and 10, the coil 5 is wound around the supporter 4 and between the first limiting part 41 and the second limiting part 42. The coil 5 is configured for generating an alternative magnetic field so that the heating element 1 generates a vortex. The coil 5 generates a high-frequency magnetic field, the heater 1 generates a vortex in the high-frequency magnetic field, the vortex enables magnetic molecules to move randomly in high speeds. Hitting and friction of the molecules may generate heat for heating the cigarette 200.

Figure 11:
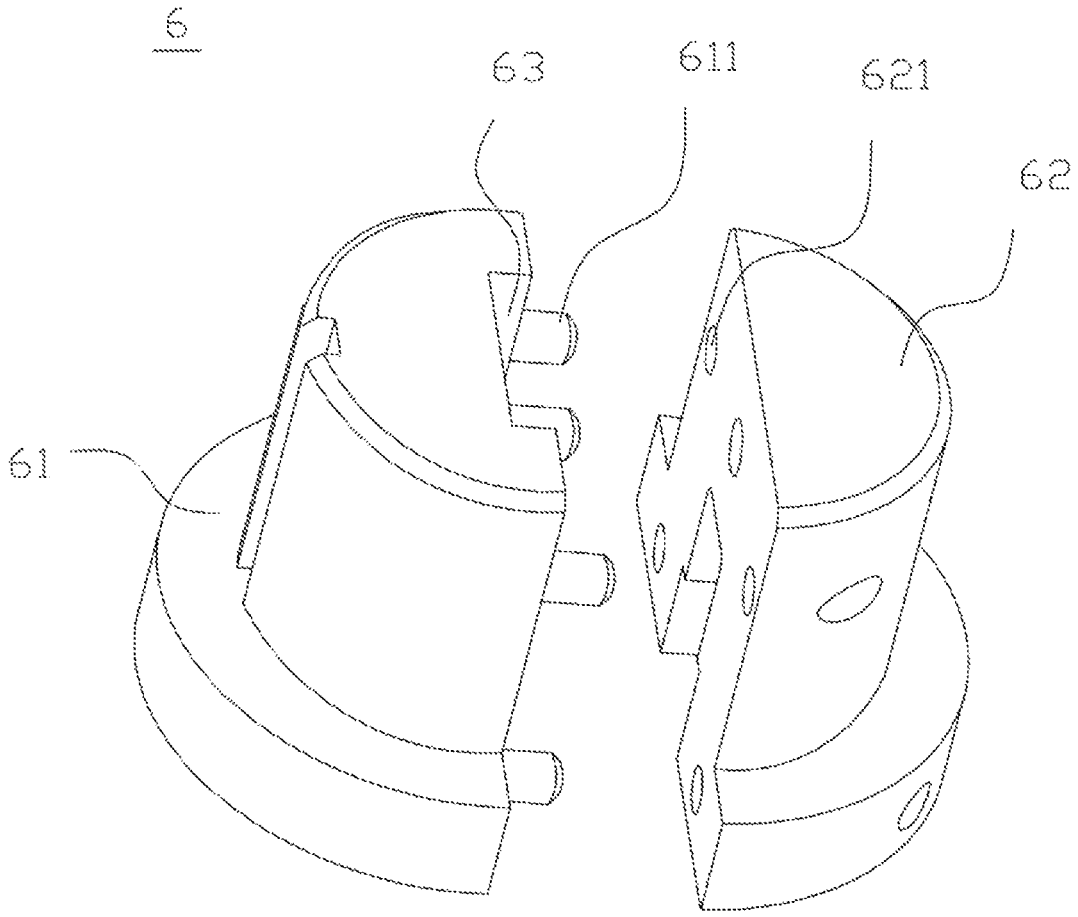
FIG. 11 is an exploded view of a base in the heater according to the third embodiment of the present disclosure; Numerals indicating components are illustrated herein.

Referring to FIGS. 7, 8 and 11, the base 6 is configured for supporting and fixing the heating element 1. The base 6 includes a first base 61 and a second base 62. The first base 61 protrudes towards the second base 62 to form a fixing pole 611. The second base 62 is concavely provided with a fixing hole 621, in this case, the fixing pole 611 inserts into the fixing hole 621 to realize a snap joint between the first base 61 and the second base 62. A receiving slot 63 is disposed between the first base 61 and the second base 62, the receiving slot 63 is configured for receiving the fixing part 10. The fixing pole 611 is extending through the fixing hole 101 bored on the fixing part 10 so as to secure the heating element 1 with the base 6.

The temperature sensor 7 is carried on the fixing part 10 of the heating element 1 and configured for detecting a temperature of the heating element 1. The temperature sensor 7 may be communicated with an external controller (not shown) for controlling the temperature of the heater 100.

The illustrated methods are exemplary only. Although the methods are illustrated as having a specific operation flow, two or more operations may be combined into a single operation, a single operation may be performed in two or more separate operations, one or more of the illustrated operations may not be present in various implementations, and/or additional operations which are not illustrated may be part of the methods. In addition, the logic flows depicted in the accompanying figures and/or described herein do not necessarily require the particular order shown, or sequential order, to achieve desirable results. Other implementations may be within the scope of the following claims.

What is claimed is:

1. A heating element for heating cigarette comprising:

a heating part at a proximal end of the heating element, with a longitudinal axis along the longitudinal direction of the heating element; the heating part is configured for inserting inside the cigarette along the longitudinal direction;

a fixing part at a distal end of the heating element and secured with the heating part, the fixing part is provided with an air inlet;

wherein, the heating part comprises an air flow path formed therein and extending along the longitudinal direction; the air inlet is in communication with the air flow path;

the heating part is bored with an air hole that communicates the air flow path with outside the heating part, such that the air flow in the air flow path is flowing into the cigarette;

wherein the heating part comprises a body and two wings, the two wings are disposed at two opposite sides of the body.

2. The heating element according to claim 1, wherein the air holes comprises numerous air holes evenly spaced and disposed on the heating part along a longitudinal direction of the heating part.

3. The heating element according to claim 2, wherein the air holes comprise numerous first air holes constituting a first air hole set, and numerous second air holes constituting a second air hole set; a line of connecting numerous first air holes, a line of connecting numerous second air holes and the longitudinal axis are parallel among each other; the first air holes and the second air holes are staggered to set along the longitudinal axis.

4. The heating element according to claim 1, wherein the heating part comprises a first transverse axis perpendicular and intersected with the longitudinal axis; the first transverse axis and the longitudinal axis are identified as a first surface; the first air holes are numerous and symmetrically set with the first surface.

5. The heating element according to claim 4, wherein heating part further comprises a second longitudinal axis that is perpendicular and intersected with the first transverse axis and the longitudinal axis; a width of the heating part is progressively decreasing from near and far from the fixing part.

6. The heating element according to claim 4, wherein the heating part further comprises a second transverse axis that is perpendicular and intersected with the first transverse axis and the longitudinal axis; the second transverse axis and the longitudinal axis are identified as the second surface; the heating part comprises a first side wall, a second side wall, a third side wall and a fourth side wall surrounded the air flow path; the first side wall and the fourth side wall are disposed at an identical side of the second surface; the second side wall and the third side wall are disposed at the other opposite side of the second surface; the first side wall, the second side wall, the third side wall and the fourth side wall are provided with the numerous air holes.

7. The heating element according to claim 6, wherein a distance between the first side wall and the fourth side wall is progressively decreasing from near and far from the second surface; a distance between the second side wall and the third side wall is progressively decreasing from near and far from the second surface.

8. The heating element according to claim 7, wherein the heating element further comprises a fifth side wall, a sixth side, a seventh side wall and an eighth side wall; the fifth side wall is configured for connecting the first side wall and the fourth side wall; the sixth side wall is configured for connecting the first side wall and the second side wall; the seventh side wall is configured for connecting the second side wall and the third side wall; the eighth side wall is configured for connecting the third side wall and the fourth side wall; the heating part further comprises a first end wall, a second end wall and a third end wall; the first end wall, the second end wall and the third end wall are disposed at the proximal end of the first side wall, the fixing part is disposed at a distal end of the first side wall; the first end wall and the second surface are perpendicular and intersected; the first end wall is configured for connecting the sixth side wall and the eighth side wall, the second end wall is configured for connecting the first side wall, the fourth side wall and the fifth side wall; a height of the second end wall is progressively decreasing from near and far from the second surface; the third end wall is configured for connecting the second side wall, the third side wall and the seventh side wall; a height of the third end wall is progressively decreasing from near and far from the second surface.

9. The heating element according to claim 1, wherein the body comprises at least one first air hole set extending through the two opposite sides of the body; numerous first air holes in each first air hole set are evenly spaced and disposed on the body.

10. The heating element according to claim 9, wherein the first air hole sets comprises two first air hole sets, lines for connecting centers of numerous first air holes in each first air hole set are parallel with each other; the wings are disposed at middle of the two first air hole sets.

11. The heating element according to claim 10, wherein each wing comprises a second air hole set extending through two opposite sides of the wing; numerous second air holes in each second air hole set are evenly spaced and disposed on the wing.

12. The heating element according to claim 11, wherein the first air holes and the second air holes are staggered to set along the longitudinal axis of the heating part.

13. The heating element according to claim 1, wherein the heating part comprises a tube-shaped structure with an end opened.

14. A heater, comprising:

a heating element; and a supporter;

wherein the supporter comprises a receptacle for receiving the cigarette, the heater is disposed in the receptacle; the heater is configured for inserting into the cigarette;

the heating element according to claim 1.

15. The heater according to claim 14, wherein the heater further comprises a coil, a first limiting part and a second limiting part are spaced and disposed on a periphery of the supporter, the coil is disposed between the first limiting part and the second limiting part.

* * * * *